United States Patent [19]

Elders et al.

[11] 4,227,143

[45] Oct. 7, 1980

[54] HIGH-VOLTAGE TRANSFORMER

[75] Inventors: Marius J. A. Elders; Jan H. M. Hopmans, both of Eindhoven, Netherlands

[73] Assignee: U.S. Philips Corporation, New York, N.Y.

[21] Appl. No.: 958,767

[22] Filed: Nov. 8, 1978

[30] Foreign Application Priority Data

Nov. 29, 1977 [NL] Netherlands ..... 7713118

[51] Int. Cl.[2] ..... G05F 7/00

[52] U.S. Cl. ..... 323/48; 336/180; 363/126

[58] Field of Search ..... 323/48; 336/180, 185, 336/189, 190; 363/125, 126

[56] References Cited

U.S. PATENT DOCUMENTS

| | | | |
|---|---|---|---|
| 3,702,451 | 11/1972 | Hofing | 336/185 X |
| 3,904,928 | 9/1975 | Sawada et al. | 336/185 X |
| 3,947,749 | 3/1976 | Kimura et al. | 363/126 |

*Primary Examiner*—William M. Shoop

*Attorney, Agent, or Firm*—Thomas A. Briody; William J. Streeter; Bernard Franzblau

[57] ABSTRACT

A high voltage transformer comprising a secondary winding composed of coils which are wound one on top of the other and which are electrically interconnected by diodes which are connected in the same rectifying sense. Each coil consists of a number of series connected sub-coils, each of which consists of a first layer of turns which contact each other, and a second layer which comprises a smaller number of turns. The first layers of two successive subcoils directly contact each other, whereas the second layers are separated by a clearance having a width equal to the wire thickness.

8 Claims, 4 Drawing Figures

HIGH-VOLTAGE TRANSFORMER

Figure 1:
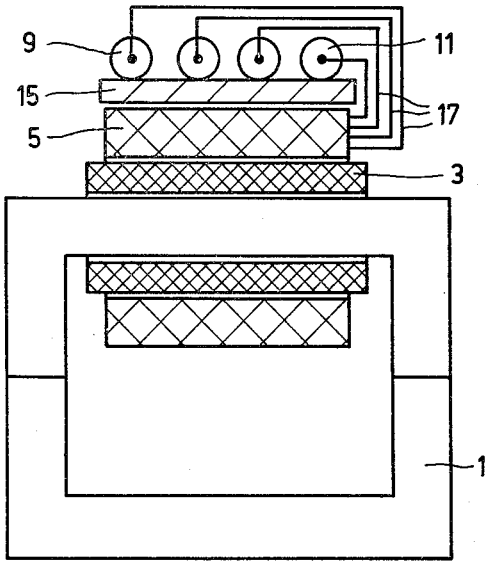

The invention relates to a high voltage transformer, comprising a ferromagnetic core on which at least one primary and one secondary winding are provided, said secondary winding consisting of a series of wire-wound coils, each of which is wound on the preceding coil and is separated therefrom by an insulating layer, every two successive coils being electrically connected by a diode with all diodes being connected in the same rectifying sense.

A high voltage transformer of this kind is described in the magazine "Funkschau" 1976, Vol. 24, pages 1051–1054. The high voltage generated per secondary coil, and hence the number of secondary coils and diodes required, depends on the number of turns per secondary coil. In order to prevent turns wherebetween a large voltage difference exists from contacting each other, and in order to ensure a properly defined capacitance between successive coils, each of the coils of the known high voltage transformer is composed of one layer of turns. This means that the high voltage generated per coil is determined by the winding length available on the core.

The invention has for an object to provide a construction in which the high voltage generated per coil is higher so that fewer coils and diodes are required. To this end, the high voltage transformer in accordance with the invention is characterized in that each coil of the series forming the secondary winding consists of a number of series-connected sub-coils, each of which consists of a first layer comprising a number of turns which contact each other over at least part of their length, and a second layer which comprises a smaller number of turns and which is wound directly on the first layer and without the provision of an insulating foil therebetween. The first layers of every two successive sub-coils directly contact each other whereas the second layers are separated from each other by a clearance whose width approximately equals the thickness of the wire.

In this construction of the secondary winding, turns having a voltage difference which is larger than in the known transformer contact each other, but the extent of this voltage difference is known in advance and can be taken into account when selecting the insulation on the wire for winding the coils. Although the voltage difference between contacting turns may now be slightly higher, this construction does not require the relatively expensive insulation foil between the adjacent wire layers of the known transformer. The construction of the coils is very regular also in the transformer in accordance with the invention, so that the capacitance between two successive coils is again very well defined. Thanks to the fact that the number of turns per coil is almost twice as large as in the known transformer for a given winding length, a smaller number of coils and diodes suffices. In addition, the clearance provided between the second layers of two successive sub-coils reduces the maximum voltage difference between contacting turns of the coil thereby reducing the insulation requirements and in turn the cost of the transformer.

Figure 2:
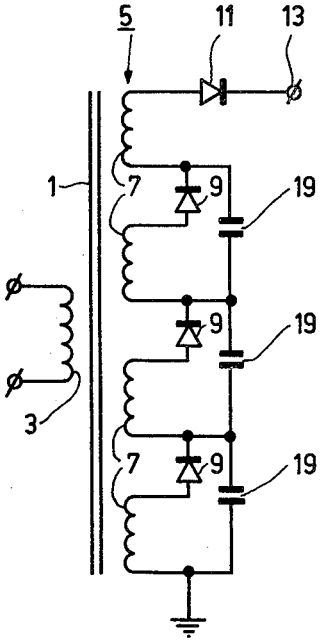
Figure 3:
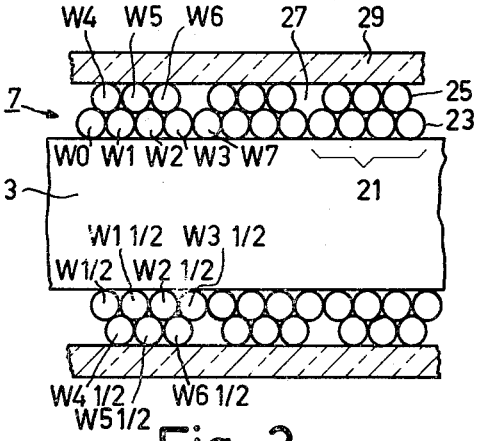
Figure 4:
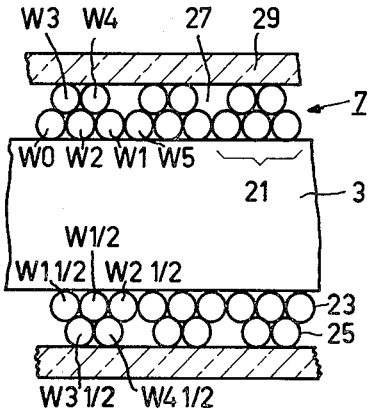

The invention will be described in detail hereinafter with reference to the accompanying drawing in which:

FIG. 1 is a diagrammatic view of the construction of an embodiment of a high voltage transformer in accordance with the invention, FIG. 2 shows an electrical diagram of the high voltage transformer shown in FIG. 1, FIG. 3 shows a detail of a first embodiment of the high voltage transformer shown in FIG. 1, and FIG. 4 shows a detail of a second embodiment of the high voltage transformer shown in FIG. 1.

The high voltage transformer shown in the FIGS. 1 and 2 (for examle, a line output transformer for a television receiver) comprises a ferromagnetic core 1 which consists of two U-shaped parts on which a primary winding 3 and a secondary winding 5 are provided. In the embodiment shown in FIG. 1, the secondary winding 5 is wound on top of the primary winding 3, but the primary winding can alternatively be provided on another part of the core. It also is possible to provide a coupling winding underneath the secondary winding, if desired.

The secondary winding 5 (see FIG. 2) is composed of a series of wire-wound coils 7 (four in this case), each of which is wound on top of the preceding one. Between every two successive coils 7 there is provided an insulating layer (not shown in FIGS. 1 and 2). Every two successive coils are electrically connected by a diode 9 with all diodes being connected in the same rectifying sense as is shown in FIG. 2. The last coil 7 is connected, via a diode 11 which is connected in the same rectifying sense, to an output terminal 13. The diodes 9 and 11 are mounted on a diode holder 15 which is arranged on the secondary winding 5 and are connected to the coils via wires 17. The assembly formed by the secondary windings and diodes is preferably moulded in synthetic resin (not shown).

Because the coils 7 are wound one on top of the other, they have a given capacitance with respect to each other which is symbolised by capacitors 19 in FIG. 2.

FIGS. 3 and 4 show a detail (not to scale) of two embodiments of one of the coils 7. It concerns the first coil of the series which is wound on the primary coil 3 provided with an insulating jacket.

The coil 7 is composed of a number of series-connected sub-coils 21, each of which consists of a first layer 23, comprising a number of turns which are wound as tightly against each other as possible, and a second layer 25, comprising a smaller number of turns which are wound in the dales between successive, contacting turns of the first layer, so that the first layers of the successive sub-coils directly adjoin each other, whereas the second layers are separated from each other by a clearance 27 whose width substantially equals the thickness of the wire. On the second layer 25 there is provided an insulating layer 29 which separates the coil 7 from the next coil of the series. This layer is made, for example, of a foil of synthetic material which is wrapped one or more times around the coil 7.

In the embodiment shown in FIG. 3, the turns of the first layer 23 are wound according to a helix whose pitch equals the wire thickness. The beginning of the first turn of the first sub-coil is denoted by the reference symbol W0, the half-way point is denoted by the reference $W\frac{1}{2}$, the end by the reference W1, and so on until the end of the first layer 23 is reached at $W3\frac{1}{2}$ after $3\frac{1}{2}$ turns. From the point $W3\frac{1}{2}$, the wire crosses to the point W4 which is situated in the dale between the starting points W0 and W1 of the first and the second turn, respectively. The second layer 25 is further formed by turns situated in the dales of the first layer, the end point being the point $W6\frac{1}{2}$ wherefrom the wire crosses to the point W7 which forms the starting point of the first layer of the next sub-coil 21.

In the embodiment shown in FIG. 4, the turns of the first layer 23 are wound with a pitch which equals twice the wire thickness. Starting with the point W0 and proceding via the point W½, the end point W1 of the first winding is reached. This point is situated at a distance from the point W0 which equals twice the wire thickness. From this point, the wire crosses to the point W1½ which is situated just ahead of the point W½, and proceeds to the point w2, situated between W0 and W1, after which it reaches the end point W2½ of the first layer which is situated just behind W½. The second layer 25 is wound, via W3, with the normal pitch of one wire thickness in the dales of the first layer 23. The end point is formed by W4½, wherefrom the wire crosses to the starting point W5 of the first layer of the second sub-coil.

It will be obvious that the wires in the embodiment shown in FIG. 4 extend substantially parallel and contact each other in two regions of the coil 7 (at the top and the bottom in the figures), but that they extend irregularly and cross each other a number of times in intermediate regions. The thickness of the first layer 23 in these regions locally amounts to more than one wire thickness. An advantage thereof is that the wires in these intermediate regions form a kind of fabric, so that the turns of the first layer 23 are rigidly connected to each other and cannot shift when the second layer 25 is wound thereon. The coil can thus be wound with a high degree of reproducibility. When the properties of the materials used are chosen so that, also in the embodiment shown in FIG. 3, the turns of the first layer 23 are not shifted during the winding of the second layer, preference will generally be given to this simpler winding technique. Some of these material properties are the friction coefficients of the surface of the wire, and the surface on which winding takes place.

When a voltage unit is defined as the voltage induced per turn, the insulation of the wire in the embodiment shown in FIG. 3 must be chosen taking into account that the voltage difference between two contacting turns can amount to at the most four units (for example, the voltage difference between the points W3 and W7). The advantage of providing a clearance 27 now becomes evident. If, for example, in FIG. 3 the twelfth turn were positioned in the clearance location, then this turn would contact the fourth turn producing a voltage difference of eight units between these two turns instead of the desired maximum of four units. In the embodiment shown in FIG. 4, this maximum difference again amounts to four units (for example, between the points W1 and W5). As the number of turns of the first layer is chosen to be larger for a given winding technique, this maxmum voltage difference between two contacting turns increases, so that more severe requirements will be imposed on the wire insulation.

What is claimed is:

1. A high voltage transformer, comprising a ferromagnetic core, at least one primary winding and one secondary winding disposed on said core with said secondary winding comprising a series of wire-wound coils, each of which is wound on the preceding coil and is separated therefrom by an insulating layer, every two successive coils being electrically connected by a diode with all diodes being connected in the same rectifying sense, and wherein each coil of the series of coils forming the secondary winding includes a number of series-connected sub-coils each of which comprises a first layer comprising a number of turns which contact each other over at least a part of their length and a second layer which comprises a smaller number of turns wound directly on the first layer, the first layers of every two successive sub-coils directly contacting each other whereas the second layers are separated from each other by a clearance space whose width approximately equals the thickness of the wire.

2. A high voltage transformer as claimed in claim 1, wherein the turns of the first layer are wound with a pitch which equals twice the wire thickness and the space between the first turns of said first layer are filled by later turns of said layer.

3. A high voltage transformer as claimed in claim 1 wherein said one secondary winding is formed by winding a single wire in a first layer that progresses axially along the core for a distance less than the axial core length, winding a second layer of said wire over the first layer so that the second layer progresses axially along the core in the same direction as for the first layer and for a distance less than the axial core length, said first and second layers forming a first sub-coil of the secondary winding, then winding the wire in a first layer of the next sub-coil along the core in the same axial direction as for the first layer of the first sub-coil and with a first turn of the first layer of said next sub-coil contacting the last turn of the first layer of the first sub-coil, and winding the second layer of said next sub-coil along the core in the same axial direction as for the first layers of the sub-coils and with said clearance space provided between the first turn of the second layer of said next sub-coil and the last turn of the second layer of the first sub-coil.

4. A high voltage transformer comprising, a ferromagnetic core, a plurality of diodes, a primary winding and a secondary winding disposed on said core with the secondary winding comprising a plurality of wire-wound coils alternately connected in series with said plurality of diodes such that any two successive coils are interconnected by a diode, all of the diodes being connected serially with the same polarity and each of the coils being wound on a preceding coil and separated therefrom by an insulating layer, and wherein said coils of the secondary winding comprise a plurality of series connected sub-coils each of which includes a first axially extending layer comprising a number of turns in contact with each other over a part of their length and a second axially extending layer comprising a smaller number of turns wound directly on the first layer, the first layers of successive sub-coils contacting each other and the second layers thereof being separated from each other by a clearance space approximately equal to the thickness of the wire.

5. A high voltage transformer as claimed in claim 4 wherein the first turn of the second layer of a first sub-coil contacts the first turn of the first layer of said first sub-coil, the last turn of the first layer of the first sub-coil contacts the first turn of the first layer of a second sub-coil and the last turn of the second layer of the first sub-coil is separated from the first turn of the second layer of the second sub-coil by said clearance space.

6. A high voltage transformer as claimed in claim 5 wherein said first and second sub-coils are axially arranged along the core and are each wound in the same axial direction.

7. A high voltage transformer as claimed in claims 4, 5 or 6 wherein the turns of at least one first layer are wound with a pitch of at least twice the wire thickness so that a space formed between said turns of the first layer is filled by later wound turns of said first layer.

8. A high voltage transformer as claimed in claim 4 wherein at least one coil of the secondary winding is formed by winding a single wire in a first layer that progresses axially from a first point of the core along the core for a distance less than the axial core length, crossing the wire back to a point in the vicinity of said first point and winding a second layer of said wire over the first layer so that the second layer progresses axially along the core in the same direction as that of the first layer and for a distance less than the axial core length, said first and second layers forming a first sub-coil of the secondary winding, then winding the wire in a first layer of the next sub-coil along the core in the same axial direction as that of the first layer of the first sub-coil and with a first turn of the first layer of said next sub-coil contacting the last turn of the first layer of the first sub-coil, crossing the wire back to a point in the vicinity of the first turn of the first layer of said next sub-coil and winding the second layer of said next sub-coil along the core in the same axial direction as that of the first layers of the sub-coils and with said clearance space provided between the first turn of the second layer of said next sub-coil and the last turn of the second layer of the first sub-coil.

* * * * *